US006366248B1

(12) United States Patent
Soutar et al.

(10) Patent No.: US 6,366,248 B1
(45) Date of Patent: Apr. 2, 2002

(54) PORTABLE RADIO ANTENNA ENHANCEMENT USING NON-CONTACTING DEVICE

(76) Inventors: Ian Soutar, 1226 Lyall Street, Victoria, British Columbia (CA), V9A 5G9; Clifford Edmund Haslam, 930 Cowichan Street, Victoria, BC (CA), V8S 4E5; James Harvey Rawling, 350 Sylvia Street, Victoria, BC (CA), V8V 1C6

( * ) Notice: Subject to any disclaimer, the term of this patent is extended or adjusted under 35 U.S.C. 154(b) by 0 days.

(21) Appl. No.: 09/777,215

(22) Filed: Feb. 5, 2001

(51) Int. Cl.[7] ..... H01Q 1/24
(52) U.S. Cl. ..... 343/702
(58) Field of Search ..... 343/833, 834, 343/713, 715, 795, 850, 700, 702, 718, 895; H01Q 1/24

(56) References Cited

U.S. PATENT DOCUMENTS 4,940,991 A * 7/1990 Sheriff ..... 343/795
5,565,877 A * 10/1996 Du et al. ..... 343/715
5,736,965 A * 4/1998 Mosebrook et al. ..... 343/702
5,886,669 A * 3/1999 Kita ..... 343/718
5,913,174 A * 6/1999 Casarez et al. ..... 455/557
6,061,037 A * 5/2000 Brouwers et al. ..... 343/895
6,097,934 A * 8/2000 Spall et al. ..... 343/702
6,172,651 B1 * 1/2001 Du ..... 343/850
6,218,991 B1 * 4/2001 Sanad ..... 343/700

FOREIGN PATENT DOCUMENTS

JP 6-276007 * 9/1994

* cited by examiner

*Primary Examiner*—Tho G. Phan
(74) *Attorney, Agent, or Firm*—Diane Kneeland

(57) ABSTRACT

An antenna enhancement system for portable radio transceivers includes a radio conductive plate 10 held in proximity to the back of the transceiver 26. Attached to the plate is a dangling wire 18 whose length bears a relationship to the frequency of transmission. This length is determined experimentally. The system increases the effectiveness of the existing antenna by 6 to 12 decibels.

2 Claims, 3 Drawing Sheets

(Details of Mounting to Radio)

(Details of Invention)

(Details of Mounting to Radio)

PORTABLE RADIO ANTENNA ENHANCEMENT USING NON-CONTACTING DEVICE

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND

1. Field of Invention

This invention relates to auxiliary antenna devices, and more particularly to portable antenna enhancing devices.

2. Description of Prior Art

Portable radios in the VHF and UHF range typically use antennas that are considerably shortened as compared to their theoretical length for ideal transmission. This is done solely for the convenience of the radio operator. A disadvantage of this shortening is a loss of efficiency that can result in a loss of up to 12 decibels of energy leaving the radio. There is also a corresponding loss of reception sensitivity.

There have been a number of antenna enhancing devices used in radio applications to improve handheld or portable radio operation. None of them have been coupled to the radio without the use of a direct electrical connection to the radio. These existing devices all operate on the basis of providing a supplementary wire antenna by connecting it directly to the shield of the existing vertical antenna on the top of the radio. Direct connection is awkward and often is achieved by placing an intermediate connector between the existing vertical antenna and the radio itself. This intermediate connector has a wire attached to it that dangles down and hangs free. None of these devices appear to have been patented and none of them fall within the scope of the present invention.

The improvement of radio performance achieved by these existing devices has been below 4 decibels. In addition the method of attachment may compromise the robustness of the radio itself by introducing mechanical strain on the antenna connector at the top of the radio. The method of attachment precludes instant attachment and removal. These prior art devices are technically complex to connect under emergency communication conditions and the possibility of dropping the primary antenna exists.

BRIEF SUMMARY OF THE INVENTION

In recognition of the above-described problems with prior designs, the inventors have developed a very simple antenna enhancement or auxiliary antenna device that is both simple to install (without any direct electrical connection to the radio), and does not have to be modified in length to use it on different sizes of radios that operate at the same frequency. The prior art devices are dependent on the radio's physical size. The invention also offers very significant improvements in radio performance that are in excess of 6 decibels and sometimes as high as 12 decibels. The invention can be instantly attached to the radio by non-conducting means, such as a snap fastener or hook and loop type fastener without the need for a connection at the antenna.

The effect of the invention is to improve the effective radiated power of the radio transceiver by about 6 to 12 decibels. Reception is also improved by a similar factor. Improvement is best in the VHF and lower UHF part of the spectrum, although some improvement can be seen at higher frequencies.

An important application for the present invention is to assist in emergency and long distance communication using portable transceivers. The present invention will effectively double the range of coverage of a portable transceiver. The present invention is a small pocket sized device that could easily be carried by Police, Army or Emergency workers to enhance communication in remote areas.

The details of one or more embodiments of the invention are set forth in the accompanying drawings and the description below. Other features, objects, and advantages of the invention will be apparent from the descriptions and drawings and from the claims.

BRIEF DESCRIPTION OF THE SEVERAL VIEWS OF THE DRAWING

One embodiment of the disclosure will be described in reference to the accompanying drawing wherein.

REFERENCE NUMERALS IN DRAWINGS

Figure 1:
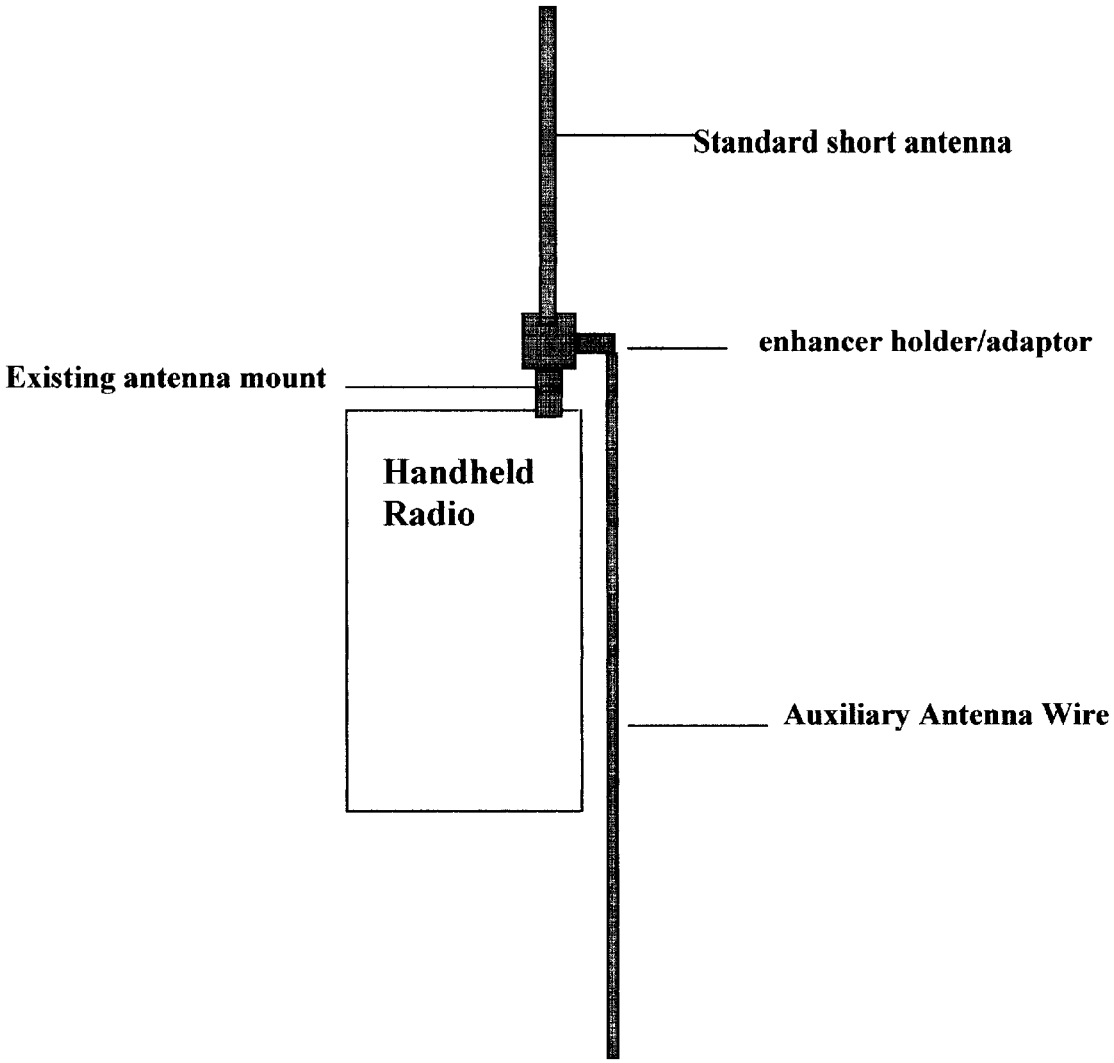
FIG. 1 (PRIOR ART)
FIG. 1 shows an embodiment of a prior art antenna enhancing device.

10 conductive plate
14 fastener
18 wire
22 metal heat sink
26 radio transceiver
32 conductive attachment

DETAILED DESCRIPTION OF THE INVENTION

Figure 2:
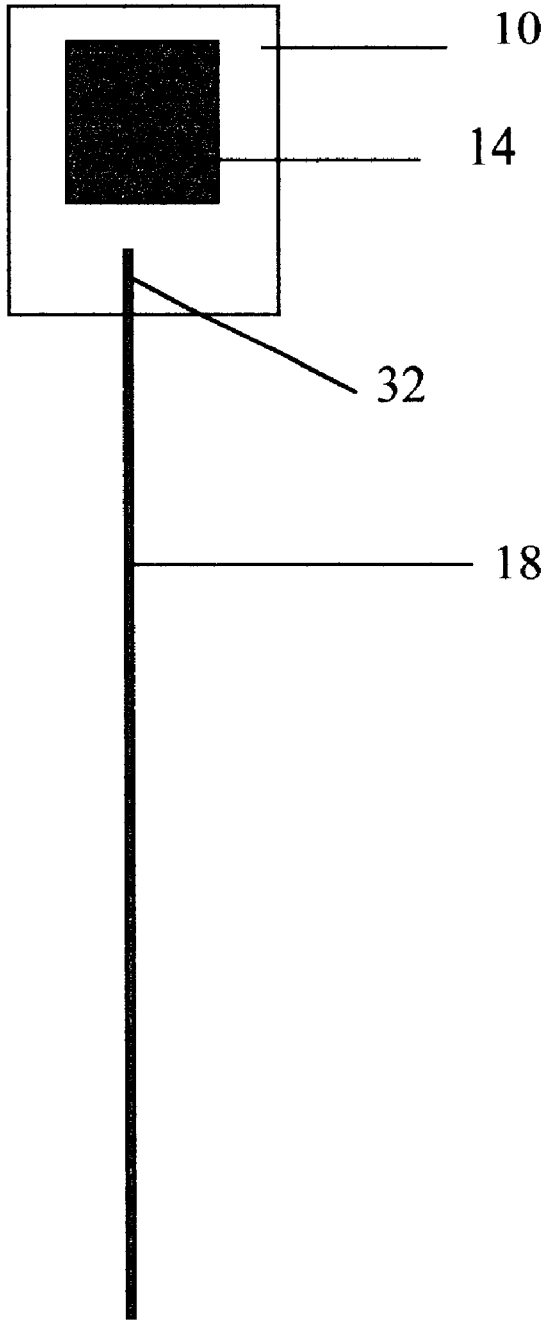
FIG. 2 shows an embodiment of the non-contacting antenna enhancement system.
Figure 3:
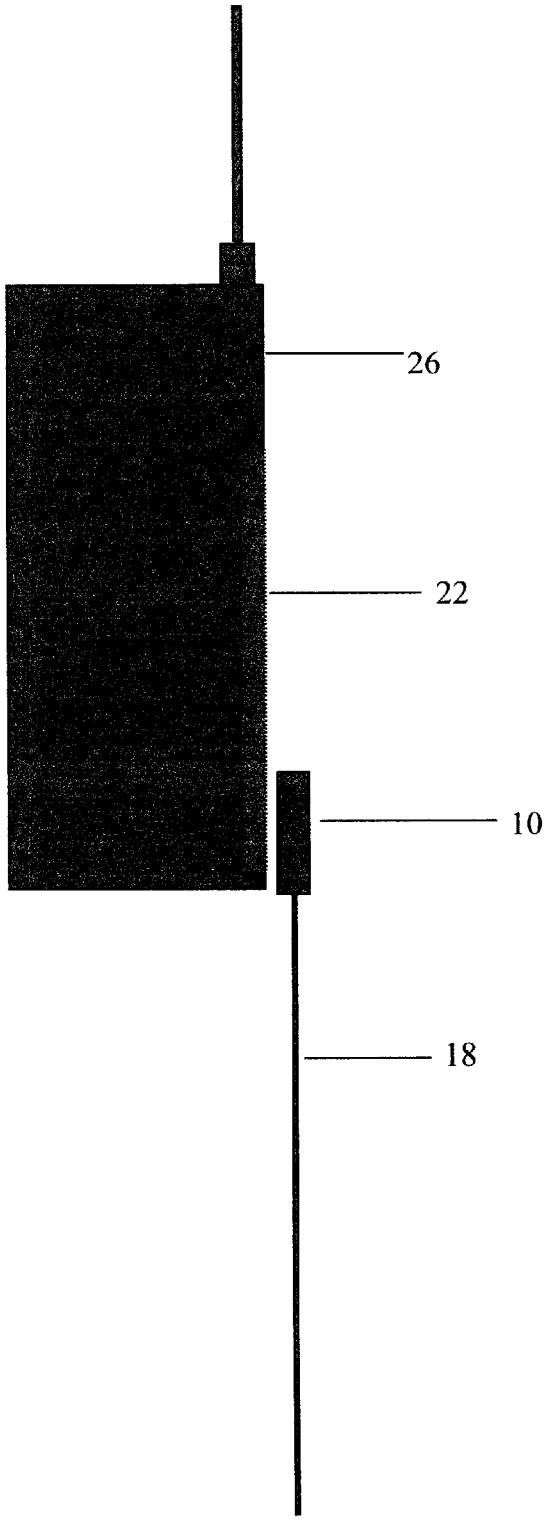
FIG. 3 shows the non-electrically contacting method of attachment of the present system to the back of a portable radio.

A typical embodiment of the auxiliary antenna of the present invention is shown in FIG. 2. The invention consists of a radio conductive plate 10 to which is attached a wire 18 of a fixed length. In the preferred embodiment, the plate 10 is approximately one square inch in size, and is comprised of a radio conductive material, such as a square of copper clad circuit board. The wire 18 in this embodiment is flexible multi-stranded copper wire. The wire is attached to the plate with a material of low electrical resistance, such as solder.

On the back of the plate is a non-conducting fastener 14. In this embodiment, a hook and loop fastener is employed. This system allows the plate to be easily attached to or removed from the back of a portable radio. The attachment to the radio is non-contacting, and the device need only be close to the metal backing of the radio. Other temporary or permanent methods of non-conducting attachment could be utilized. This non-contacting method of coupling is what makes the invention unique from the prior art. The plate 10 is attached in close proximity to the metal heat sink 22, usually located at the back of a portable radio transceiver 26.

The attached wire 18 is allowed to hang freely from the plate 10. Experimentally we determined that the length measured from the center of the plate to the free end of the wire must be an exact length, plus or minus 20%, in relation to the frequency of radio transmission.

L =(146/Frequency in megahertz) times 22.

Where L is length in inches and F is the frequency of radio transmission in megahertz.

The wire functions as a secondary antenna. The wire serves to radiate a considerable amount of energy that would normally be lost as heat in a radio without the invention mounted.

There are techniques for shortening radio antennas that have been used since the early days of radio. Typically a coil is used to reduce the length of an antenna. Capacitors can also be used. Use of antenna shortening techniques lie within the scope of the invention. However the preferred embodiment does not make use of these techniques in order to reduce the cost of production of the invention.

The scope of the invention should be determined by the appended claims, and their legal equivalents, rather than by the examples given.

We claim:

1. An antenna enhancing system for a portable radio transmitter, receiver or transceiver, comprising:

a. a conductive plate having a front surface and a back surface, b. a conducting wire having a free end and an attached end, wherein the attached end is attached conductively to the front surface of the conductive plate, and the back surface of the conductive plate is located in close proximity to the portable radio transmitter, receiver or transceiver, c. the conducting wire has a length in inches related to a frequency of transmission or reception of the portable radio transmitter, receiver or transceiver by a formula (146/Frequency in megahertz) times 22, + or −20%.

2. A method for enhancing a signal transmitted to or from a radio, comprising the steps of:

a. positioning a plate in non-conducting proximity to a heat sink of the radio, and b. conductively attaching a flexible wire to the plate, and c. adjusting a length of the wire according to a formula relating the length of the wire in inches to a frequency of a transmission in megahertz, whereby a radio signal is enhanced by 6 to 12 decibels.

* * * * *